US005702106A

United States Patent [19]

Alvarez, Jr.

[11] Patent Number: 5,702,106

[45] Date of Patent: Dec. 30, 1997

[54] METHOD OF PLAYING A CASINO TYPE CARD GAME

[76] Inventor: Manuel M. Alvarez, Jr., 4611 Ellenwood Dr., Los Angeles, Calif. 90041

[21] Appl. No.: 680,364

[22] Filed: Jul. 15, 1996

[51] Int. Cl.[6] ..... A63F 1/00

[52] U.S. Cl. ..... 273/292

[58] Field of Search ..... 273/292, 274, 273/309

[56] References Cited

U.S. PATENT DOCUMENTS

| | | | |
|---|---|---|---|
| 5,395,119 | 3/1995 | Jacob et al. | 273/274 |
| 5,452,899 | 9/1995 | Skratulia et al. | 273/292 |
| 5,522,595 | 6/1996 | Wong | 273/292 |
| 5,540,444 | 7/1996 | Nguyen | 273/292 |

OTHER PUBLICATIONS

9's Up, Harrah's Gaming Guide, Harrah's, 1988.

Over/Under 13 Blackjack, Gaming Concepts, Inc., 1988.

Scarney Baccarat, Scarne's Encyclopedia of Games by John Scarne Harper & Row Publishers, pp. 297–302, 1973.

*Primary Examiner*—Benjamin H. Layno

*Attorney, Agent, or Firm*—Natan Epstein

[57] ABSTRACT

In a card game wherein a two card hand is dealt to a player, a wager is placed on the sum value of the hand being either "nine-up" or "eight-down". The sum value is determined by adding the numerical face value of the two cards of any non-pair hand, figure cards having a zero value. "Nine-up" includes sum values of 9 to 19 while "eight-down" includes sum values of 0 to 8. Pair hands, i.e. two similar figure cards or having equal face value, regardless of suit, are given rankings different from those of non-pair hands.

24 Claims, 9 Drawing Sheets

TABLE 1

TWO CARD COMBINATION

| | TWO CARD | COMBINATION POSSIBILITY | PERCENT PROBABILITY | TOTAL COMBINATION | TOTAL % PROBABILTY |
|---|---|---|---|---|---|
| PAIR HANDS | pair A | 6 | 0.45% | | |
| | pair K | 6 | 0.45% | | |
| | pair Q | 6 | 0.45% | | |
| | pair J | 6 | 0.45% | | |
| | pair 10 | 6 | 0.45% | | |
| | pair 9 | 6 | 0.45% | | |
| | pair 8 | 6 | 0.45% | PAIR | |
| | pair 7 | 6 | 0.45% | | |
| | pair 6 | 6 | 0.45% | | |
| | pair 5 | 6 | 0.45% | | |
| | pair 4 | 6 | 0.45% | | |
| | pair 3 | 6 | 0.45% | | |
| | pair 2 | 6 | 0.45% | 78 | 5.88% |
| NON-PAIR HANDS | 0 | 48 | 3.62% | | |
| | 1 | 48 | 3.62% | | |
| | 2 | 48 | 3.62% | | |
| | 3 | 64 | 4.83% | | |
| | 4 | 64 | 4.83% | 8-DOWN | |
| | 5 | 80 | 6.03% | | |
| | 6 | 80 | 6.03% | | |
| | 7 | 96 | 7.24% | | |
| | 8 | 96 | 7.24% | 624 | 47.06% |
| | 9 | 112 | 8.45% | | |
| | 10 | 112 | 8.45% | | |
| | 11 | 80 | 6.03% | | |
| | 12 | 64 | 4.83% | | |
| | 13 | 64 | 4.83% | | |
| | 14 | 48 | 3.62% | 9-UP | |
| | 15 | 48 | 3.62% | | |
| | 16 | 32 | 2.41% | | |
| | 17 | 32 | 2.41% | | |
| | 18 | 16 | 1.21% | | |
| | 19 | 16 | 1.21% | | |
| | 20 | 0 | 0.00% | 624 | 47.06% |
| | | 1326 | 100.00% | 1326 | 100.00% |

TABLE 1

TWO CARD COMBINATION

| | TWO CARD | COMBINATION POSSIBILITY | PERCENT PROBABILITY | TOTAL COMBINATION | TOTAL % PROBABILTY |
|---|---|---|---|---|---|
| PAIR HANDS | pair A | 6 | 0.45% | | |
| | pair K | 6 | 0.45% | | |
| | pair Q | 6 | 0.45% | | |
| | pair J | 6 | 0.45% | | |
| | pair 10 | 6 | 0.45% | | |
| | pair 9 | 6 | 0.45% | | |
| | pair 8 | 6 | 0.45% | PAIR | |
| | pair 7 | 6 | 0.45% | | |
| | pair 6 | 6 | 0.45% | | |
| | pair 5 | 6 | 0.45% | | |
| | pair 4 | 6 | 0.45% | | |
| | pair 3 | 6 | 0.45% | | |
| | pair 2 | 6 | 0.45% | 78 | 5.88% |
| NON-PAIR HANDS | 0 | 48 | 3.62% | | |
| | 1 | 48 | 3.62% | | |
| | 2 | 48 | 3.62% | | |
| | 3 | 64 | 4.83% | | |
| | 4 | 64 | 4.83% | 8-DOWN | |
| | 5 | 80 | 6.03% | | |
| | 6 | 80 | 6.03% | | |
| | 7 | 96 | 7.24% | | |
| | 8 | 96 | 7.24% | 624 | 47.06% |
| | 9 | 112 | 8.45% | | |
| | 10 | 112 | 8.45% | | |
| | 11 | 80 | 6.03% | | |
| | 12 | 64 | 4.83% | | |
| | 13 | 64 | 4.83% | | |
| | 14 | 48 | 3.62% | 9-UP | |
| | 15 | 48 | 3.62% | | |
| | 16 | 32 | 2.41% | | |
| | 17 | 32 | 2.41% | | |
| | 18 | 16 | 1.21% | | |
| | 19 | 16 | 1.21% | | |
| | 20 | 0 | 0.00% | 624 | 47.06% |
| | | 1326 | 100.00% | 1326 | 100.00% |

Fig. 1

TABLE 2
TWO CARD COMBINATION POSSIBILITIES
I - PAIR HANDS

78 POSSIBILITIES

| | | | | | | |
|---|---|---|---|---|---|---|
| A♥ & A♦ | 2♥ & 2♦ | 3♥ & 3♦ | 4♥ & 4♦ | 5♥ & 5♦ | 6♥ & 6♦ | 7♥ & 7♦ |
| A♥ & A♠ | 2♥ & 2♠ | 3♥ & 3♠ | 4♥ & 4♠ | 5♥ & 5♠ | 6♥ & 6♠ | 7♥ & 7♠ |
| A♥ & A♣ | 2♥ & 2♣ | 3♥ & 3♣ | 4♥ & 4♣ | 5♥ & 5♣ | 6♥ & 6♣ | 7♥ & 7♣ |
| A♦ & A♠ | 2♦ & 2♠ | 3♦ & 3♠ | 4♦ & 4♠ | 5♦ & 5♠ | 6♦ & 6♠ | 7♦ & 7♠ |
| A♦ & A♣ | 2♦ & 2♣ | 3♦ & 3♣ | 4♦ & 4♣ | 5♦ & 5♣ | 6♦ & 6♣ | 7♦ & 7♣ |
| A♠ & A♣ | 2♠ & 2♣ | 3♠ & 3♣ | 4♠ & 4♣ | 5♠ & 5♣ | 6♠ & 6♣ | 7♠ & 7♣ |

| | | | | | |
|---|---|---|---|---|---|
| 8♥ & 8♦ | 9♥ & 9♦ | 10♥ & 10♦ | J♥ & J♦ | Q♥ & Q♦ | K♥ & K♦ |
| 8♥ & 8♠ | 9♥ & 9♠ | 10♥ & 10♠ | J♥ & J♠ | Q♥ & Q♠ | K♥ & K♠ |
| 8♥ & 8♣ | 9♥ & 9♣ | 10♥ & 10♣ | J♥ & J♣ | Q♥ & Q♣ | K♥ & K♣ |
| 8♦ & 8♠ | 9♦ & 9♠ | 10♦ & 10♠ | J♦ & J♠ | Q♦ & Q♠ | K♦ & K♠ |
| 8♦ & 8♣ | 9♦ & 9♣ | 10♦ & 10♣ | J♦ & J♣ | Q♦ & Q♣ | K♦ & K♣ |
| 8♠ & 8♣ | 9♠ & 9♣ | 10♠ & 10♣ | J♠ & J♣ | Q♠ & Q♣ | K♠ & K♣ |

II - NON-PAIR HANDS 0 (ZERO) - 48 POSSIBILITIES

| | | |
|---|---|---|
| K♥ & Q♥ | K♥ & J♥ | Q♥ & J♥ |
| K♥ & Q♠ | K♥ & J♠ | Q♥ & J♠ |
| K♥ & Q♦ | K♥ & J♦ | Q♥ & J♦ |
| K♥ & Q♣ | K♥ & J♣ | Q♥ & J♣ |
| K♠ & Q♥ | K♠ & J♥ | Q♠ & J♥ |
| K♠ & Q♠ | K♠ & J♠ | Q♠ & J♠ |
| K♠ & Q♦ | K♠ & J♦ | Q♠ & J♦ |
| K♠ & Q♣ | K♠ & J♣ | Q♠ & J♣ |
| K♦ & Q♥ | K♦ & J♥ | Q♦ & J♥ |
| K♦ & Q♠ | K♦ & J♠ | Q♦ & J♠ |
| K♦ & Q♦ | K♦ & J♦ | Q♦ & J♦ |
| K♦ & Q♣ | K♦ & J♣ | Q♦ & J♣ |
| K♣ & Q♥ | K♣ & J♥ | Q♣ & J♥ |
| K♣ & Q♠ | K♣ & J♠ | Q♣ & J♠ |
| K♣ & Q♦ | K♣ & J♦ | Q♣ & J♦ |
| K♣ & Q♣ | K♣ & J♣ | Q♣ & J♣ |

1 (ONE) - 48 POSSIBILITIES

| | | |
|---|---|---|
| K♥ & A♥ | Q♥ & A♥ | J♥ & A♥ |
| K♥ & A♠ | Q♥ & A♠ | J♥ & A♠ |
| K♥ & A♦ | Q♥ & A♦ | J♥ & A♦ |
| K♥ & A♣ | Q♥ & A♣ | J♥ & A♣ |
| K♠ & A♥ | Q♠ & A♥ | J♠ & A♥ |
| K♠ & A♠ | Q♠ & A♠ | J♠ & A♠ |
| K♠ & A♦ | Q♠ & A♦ | J♠ & A♦ |
| K♠ & A♣ | Q♠ & A♣ | J♠ & A♣ |
| K♦ & A♥ | Q♦ & A♥ | J♦ & A♥ |
| K♦ & A♠ | Q♦ & A♠ | J♦ & A♠ |
| K♦ & A♦ | Q♦ & A♦ | J♦ & A♦ |
| K♦ & A♣ | Q♦ & A♣ | J♦ & A♣ |
| K♣ & A♥ | Q♣ & A♥ | J♣ & A♥ |
| K♣ & A♠ | Q♣ & A♠ | J♣ & A♠ |
| K♣ & A♦ | Q♣ & A♦ | J♣ & A♦ |
| K♣ & A♣ | Q♣ & A♣ | J♣ & A♣ |

Fig. 2a

Table 2 continued . . .

2 (TWO)- 48 POSSIBILITIES

| | | |
|---|---|---|
| K♥ & 2♥ | Q♥ & 2♥ | J♥ & 2♥ |
| K♥ & 2♠ | Q♥ & 2♠ | J♥ & 2♠ |
| K♥ & 2♦ | Q♥ & 2♦ | J♥ & 2♦ |
| K♥ & 2♣ | Q♥ & 2♣ | J♥ & 2♣ |
| K♠ & 2♥ | Q♠ & 2♥ | J♠ & 2♥ |
| K♠ & 2♠ | Q♠ & 2♠ | J♠ & 2♠ |
| K♠ & 2♦ | Q♠ & 2♦ | J♠ & 2♦ |
| K♠ & 2♣ | Q♠ & 2♣ | J♠ & 2♣ |
| K♦ & 2♥ | Q♦ & 2♥ | J♦ & 2♥ |
| K♦ & 2♠ | Q♦ & 2♠ | J♦ & 2♠ |
| K♦ & 2♦ | Q♦ & 2♦ | J♦ & 2♦ |
| K♦ & 2♣ | Q♦ & 2♣ | J♦ & 2♣ |
| K♣ & 2♥ | Q♣ & 2♥ | J♣ & 2♥ |
| K♣ & 2♠ | Q♣ & 2♠ | J♣ & 2♠ |
| K♣ & 2♦ | Q♣ & 2♦ | J♣ & 2♦ |
| K♣ & 2♣ | Q♣ & 2♣ | J♣ & 2♣ |

3 (THREE) - 64 POSSIBILITIES

| | | | |
|---|---|---|---|
| K♥ & 3♥ | Q♥ & 3♥ | J♥ & 3♥ | A♥ & 2♥ |
| K♥ & 3♠ | Q♥ & 3♠ | J♥ & 3♠ | A♥ & 2♠ |
| K♥ & 3♦ | Q♥ & 3♦ | J♥ & 3♦ | A♥ & 2♦ |
| K♥ & 3♣ | Q♥ & 3♣ | J♥ & 3♣ | A♥ & 2♣ |
| K♠ & 3♥ | Q♠ & 3♥ | J♠ & 3♥ | A♠ & 2♥ |
| K♠ & 3♠ | Q♠ & 3♠ | J♠ & 3♠ | A♠ & 2♠ |
| K♠ & 3♦ | Q♠ & 3♦ | J♠ & 3♦ | A♠ & 2♦ |
| K♠ & 3♣ | Q♠ & 3♣ | J♠ & 3♣ | A♠ & 2♣ |
| K♦ & 3♥ | Q♦ & 3♥ | J♦ & 3♥ | A♦ & 2♥ |
| K♦ & 3♠ | Q♦ & 3♠ | J♦ & 3♠ | A♦ & 2♠ |
| K♦ & 3♦ | Q♦ & 3♦ | J♦ & 3♦ | A♦ & 2♦ |
| K♦ & 3♣ | Q♦ & 3♣ | J♦ & 3♣ | A♦ & 2♣ |
| K♣ & 3♥ | Q♣ & 3♥ | J♣ & 3♥ | A♣ & 2♥ |
| K♣ & 3♠ | Q♣ & 3♠ | J♣ & 3♠ | A♣ & 2♠ |
| K♣ & 3♦ | Q♣ & 3♦ | J♣ & 3♦ | A♣ & 2♦ |
| K♣ & 3♣ | Q♣ & 3♣ | J♣ & 3♣ | A♣ & 2♣ |

4 (FOUR) - 64 POSSIBILITIES

| | | | |
|---|---|---|---|
| K♥ & 4♥ | Q♥ & 4♥ | J♥ & 4♥ | A♥ & 3♥ |
| K♥ & 4♠ | Q♥ & 4♠ | J♥ & 4♠ | A♥ & 3♠ |
| K♥ & 4♦ | Q♥ & 4♦ | J♥ & 4♦ | A♥ & 3♦ |
| K♥ & 4♣ | Q♥ & 4♣ | J♥ & 4♣ | A♥ & 3♣ |
| K♠ & 4♥ | Q♠ & 4♥ | J♠ & 4♥ | A♠ & 3♥ |
| K♠ & 4♠ | Q♠ & 4♠ | J♠ & 4♠ | A♠ & 3♠ |
| K♠ & 4♦ | Q♠ & 4♦ | J♠ & 4♦ | A♠ & 3♦ |
| K♠ & 4♣ | Q♠ & 4♣ | J♠ & 4♣ | A♠ & 3♣ |
| K♦ & 4♥ | Q♦ & 4♥ | J♦ & 4♥ | A♦ & 3♥ |
| K♦ & 4♠ | Q♦ & 4♠ | J♦ & 4♠ | A♦ & 3♠ |
| K♦ & 4♦ | Q♦ & 4♦ | J♦ & 4♦ | A♦ & 3♦ |
| K♦ & 4♣ | Q♦ & 4♣ | J♦ & 4♣ | A♦ & 3♣ |
| K♣ & 4♥ | Q♣ & 4♥ | J♣ & 4♥ | A♣ & 3♥ |
| K♣ & 4♠ | Q♣ & 4♠ | J♣ & 4♠ | A♣ & 3♠ |
| K♣ & 4♦ | Q♣ & 4♦ | J♣ & 4♦ | A♣ & 3♦ |
| K♣ & 4♣ | Q♣ & 4♣ | J♣ & 4♣ | A♣ & 3♣ |

Fig. 2b

Table 2 continued . . .

5 (FIVE) - 80 POSSIBILITIES

| | | | | |
|---|---|---|---|---|
| K♥ & 5♥ | Q♥ & 5♥ | J♥ & 5♥ | A♥ & 4♥ | 2♥ & 3♥ |
| K♥ & 5♠ | Q♥ & 5♠ | J♥ & 5♠ | A♥ & 4♠ | 2♥ & 3♠ |
| K♥ & 5♦ | Q♥ & 5♦ | J♥ & 5♦ | A♥ & 4♦ | 2♥ & 3♦ |
| K♥ & 5♣ | Q♥ & 5♣ | J♥ & 5♣ | A♥ & 4♣ | 2♥ & 3♣ |
| K♠ & 5♥ | Q♠ & 5♥ | J♠ & 5♥ | A♠ & 4♥ | 2♠ & 3♥ |
| K♠ & 5♠ | Q♠ & 5♠ | J♠ & 5♠ | A♠ & 4♠ | 2♠ & 3♠ |
| K♠ & 5♦ | Q♠ & 5♦ | J♠ & 5♦ | A♠ & 4♦ | 2♠ & 3♦ |
| K♠ & 5♣ | Q♠ & 5♣ | J♠ & 5♣ | A♠ & 4♣ | 2♠ & 3♣ |
| K♦ & 5♥ | Q♦ & 5♥ | J♦ & 5♥ | A♦ & 4♥ | 2♦ & 3♥ |
| K♦ & 5♠ | Q♦ & 5♠ | J♦ & 5♠ | A♦ & 4♠ | 2♦ & 3♠ |
| K♦ & 5♦ | Q♦ & 5♦ | J♦ & 5♦ | A♦ & 4♦ | 2♦ & 3♦ |
| K♦ & 5♣ | Q♦ & 5♣ | J♦ & 5♣ | A♦ & 4♣ | 2♦ & 3♣ |
| K♣ & 5♥ | Q♣ & 5♥ | J♣ & 5♥ | A♣ & 4♥ | 2♣ & 3♥ |
| K♣ & 5♠ | Q♣ & 5♠ | J♣ & 5♠ | A♣ & 4♠ | 2♣ & 3♠ |
| K♣ & 5♦ | Q♣ & 5♦ | J♣ & 5♦ | A♣ & 4♦ | 2♣ & 3♦ |
| K♣ & 5♣ | Q♣ & 5♣ | J♣ & 5♣ | A♣ & 4♣ | 2♣ & 3♣ |

6 (SIX) - 80 POSSIBILITIES

| | | | | |
|---|---|---|---|---|
| K♥ & 6♥ | Q♥ & 6♥ | J♥ & 6♥ | A♥ & 5♥ | 2♥ & 4♥ |
| K♥ & 6♠ | Q♥ & 6♠ | J♥ & 6♠ | A♥ & 5♠ | 2♥ & 4♠ |
| K♥ & 6♦ | Q♥ & 6♦ | J♥ & 6♦ | A♥ & 5♦ | 2♥ & 4♦ |
| K♥ & 6♣ | Q♥ & 6♣ | J♥ & 6♣ | A♥ & 5♣ | 2♥ & 4♣ |
| K♠ & 6♥ | Q♠ & 6♥ | J♠ & 6♥ | A♠ & 5♥ | 2♠ & 4♥ |
| K♠ & 6♠ | Q♠ & 6♠ | J♠ & 6♠ | A♠ & 5♠ | 2♠ & 4♠ |
| K♠ & 6♦ | Q♠ & 6♦ | J♠ & 6♦ | A♠ & 5♦ | 2♠ & 4♦ |
| K♠ & 6♣ | Q♠ & 6♣ | J♠ & 6♣ | A♠ & 5♣ | 2♠ & 4♣ |
| K♦ & 6♥ | Q♦ & 6♥ | J♦ & 6♥ | A♦ & 5♥ | 2♦ & 4♥ |
| K♦ & 6♠ | Q♦ & 6♠ | J♦ & 6♠ | A♦ & 5♠ | 2♦ & 4♠ |
| K♦ & 6♦ | Q♦ & 6♦ | J♦ & 6♦ | A♦ & 5♦ | 2♦ & 4♦ |
| K♦ & 6♣ | Q♦ & 6♣ | J♦ & 6♣ | A♦ & 5♣ | 2♦ & 4♣ |
| K♣ & 6♥ | Q♣ & 6♥ | J♣ & 6♥ | A♣ & 5♥ | 2♣ & 4♥ |
| K♣ & 6♠ | Q♣ & 6♠ | J♣ & 6♠ | A♣ & 5♠ | 2♣ & 4♠ |
| K♣ & 6♦ | Q♣ & 6♦ | J♣ & 6♦ | A♣ & 5♦ | 2♣ & 4♦ |
| K♣ & 6♣ | Q♣ & 6♣ | J♣ & 6♣ | A♣ & 5♣ | 2♣ & 4♣ |

Fig. 2c

Table 2 continued . . .

7 (SEVEN) - 96 POSSIBILITIES

| | | | | | |
|---|---|---|---|---|---|
| K♥ & 7♥ | Q♥ & 7♥ | J♥ & 7♥ | A♥ & 6♥ | 2♥ & 5♥ | 3♥ & 4♥ |
| K♥ & 7♠ | Q♥ & 7♠ | J♥ & 7♠ | A♥ & 6♠ | 2♥ & 5♠ | 3♥ & 4♠ |
| K♥ & 7♦ | Q♥ & 7♦ | J♥ & 7♦ | A♥ & 6♦ | 2♥ & 5♦ | 3♥ & 4♦ |
| K♥ & 7♣ | Q♥ & 7♣ | J♥ & 7♣ | A♥ & 6♣ | 2♥ & 5♣ | 3♥ & 4♣ |
| K♠ & 7♥ | Q♠ & 7♥ | J♠ & 7♥ | A♠ & 6♥ | 2♠ & 5♥ | 3♠ & 4♥ |
| K♠ & 7♠ | Q♠ & 7♠ | J♠ & 7♠ | A♠ & 6♠ | 2♠ & 5♠ | 3♠ & 4♠ |
| K♠ & 7♦ | Q♠ & 7♦ | J♠ & 7♦ | A♠ & 6♦ | 2♠ & 5♦ | 3♠ & 4♦ |
| K♠ & 7♣ | Q♠ & 7♣ | J♠ & 7♣ | A♠ & 6♣ | 2♠ & 5♣ | 3♠ & 4♣ |
| K♦ & 7♥ | Q♦ & 7♥ | J♦ & 7♥ | A♦ & 6♥ | 2♦ & 5♥ | 3♦ & 4♥ |
| K♦ & 7♠ | Q♦ & 7♠ | J♦ & 7♠ | A♦ & 6♠ | 2♦ & 5♠ | 3♦ & 4♠ |
| K♦ & 7♦ | Q♦ & 7♦ | J♦ & 7♦ | A♦ & 6♦ | 2♦ & 5♦ | 3♦ & 4♦ |
| K♦ & 7♣ | Q♦ & 7♣ | J♦ & 7♣ | A♦ & 6♣ | 2♦ & 5♣ | 3♦ & 4♣ |
| K♣ & 7♥ | Q♣ & 7♥ | J♣ & 7♥ | A♣ & 6♥ | 2♣ & 5♥ | 3♣ & 4♥ |
| K♣ & 7♠ | Q♣ & 7♠ | J♣ & 7♠ | A♣ & 6♠ | 2♣ & 5♠ | 3♣ & 4♠ |
| K♣ & 7♦ | Q♣ & 7♦ | J♣ & 7♦ | A♣ & 6♦ | 2♣ & 5♦ | 3♣ & 4♦ |
| K♣ & 7♣ | Q♣ & 7♣ | J♣ & 7♣ | A♣ & 6♣ | 2♣ & 5♣ | 3♣ & 4♣ |

8 (EIGHT) - 96 POSSIBILITIES

| | | | | | |
|---|---|---|---|---|---|
| K♥ & 8♥ | Q♥ & 8♥ | J♥ & 8♥ | A♥ & 7♥ | 2♥ & 6♥ | 3♥ & 5♥ |
| K♥ & 8♠ | Q♥ & 8♠ | J♥ & 8♠ | A♥ & 7♠ | 2♥ & 6♠ | 3♥ & 5♠ |
| K♥ & 8♦ | Q♥ & 8♦ | J♥ & 8♦ | A♥ & 7♦ | 2♥ & 6♦ | 3♥ & 5♦ |
| K♥ & 8♣ | Q♥ & 8♣ | J♥ & 8♣ | A♥ & 7♣ | 2♥ & 6♣ | 3♥ & 5♣ |
| K♠ & 8♥ | Q♠ & 8♥ | J♠ & 8♥ | A♠ & 7♥ | 2♠ & 6♥ | 3♠ & 5♥ |
| K♠ & 8♠ | Q♠ & 8♠ | J♠ & 8♠ | A♠ & 7♠ | 2♠ & 6♠ | 3♠ & 5♠ |
| K♠ & 8♦ | Q♠ & 8♦ | J♠ & 8♦ | A♠ & 7♦ | 2♠ & 6♦ | 3♠ & 5♦ |
| K♠ & 8♣ | Q♠ & 8♣ | J♠ & 8♣ | A♠ & 7♣ | 2♠ & 6♣ | 3♠ & 5♣ |
| K♦ & 8♥ | Q♦ & 8♥ | J♦ & 8♥ | A♦ & 7♥ | 2♦ & 6♥ | 3♦ & 5♥ |
| K♦ & 8♠ | Q♦ & 8♠ | J♦ & 8♠ | A♦ & 7♠ | 2♦ & 6♠ | 3♦ & 5♠ |
| K♦ & 8♦ | Q♦ & 8♦ | J♦ & 8♦ | A♦ & 7♦ | 2♦ & 6♦ | 3♦ & 5♦ |
| K♦ & 8♣ | Q♦ & 8♣ | J♦ & 8♣ | A♦ & 7♣ | 2♦ & 6♣ | 3♦ & 5♣ |
| K♣ & 8♥ | Q♣ & 8♥ | J♣ & 8♥ | A♣ & 7♥ | 2♣ & 6♥ | 3♣ & 5♥ |
| K♣ & 8♠ | Q♣ & 8♠ | J♣ & 8♠ | A♣ & 7♠ | 2♣ & 6♠ | 3♣ & 5♠ |
| K♣ & 8♦ | Q♣ & 8♦ | J♣ & 8♦ | A♣ & 7♦ | 2♣ & 6♦ | 3♣ & 5♦ |
| K♣ & 8♣ | Q♣ & 8♣ | J♣ & 8♣ | A♣ & 7♣ | 2♣ & 6♣ | 3♣ & 5♣ |

Fig. 2d

Table 2 continued . . . 9 (NINE) - 112 POSSIBILITIES

| | | | | | | |
|---|---|---|---|---|---|---|
| K♥ & 9♥ | Q♥ & 9♥ | J♥ & 9♥ | A♥ & 8♥ | 2♥ & 7♥ | 3♥ & 6♥ | 4♥ & 5♥ |
| K♥ & 9♠ | Q♥ & 9♠ | J♥ & 9♠ | A♥ & 8♠ | 2♥ & 7♠ | 3♥ & 6♠ | 4♥ & 5♠ |
| K♥ & 9♦ | Q♥ & 9♦ | J♥ & 9♦ | A♥ & 8♦ | 2♥ & 7♦ | 3♥ & 6♦ | 4♥ & 5♦ |
| K♥ & 9♣ | Q♥ & 9♣ | J♥ & 9♣ | A♥ & 8♣ | 2♥ & 7♣ | 3♥ & 6♣ | 4♥ & 5♣ |
| K♠ & 9♥ | Q♠ & 9♥ | J♠ & 9♥ | A♠ & 8♥ | 2♠ & 7♥ | 3♠ & 6♥ | 4♠ & 5♥ |
| K♠ & 9♠ | Q♠ & 9♠ | J♠ & 9♠ | A♠ & 8♠ | 2♠ & 7♠ | 3♠ & 6♠ | 4♠ & 5♠ |
| K♠ & 9♦ | Q♠ & 9♦ | J♠ & 9♦ | A♠ & 8♦ | 2♠ & 7♦ | 3♠ & 6♦ | 4♠ & 5♦ |
| K♠ & 9♣ | Q♠ & 9♣ | J♠ & 9♣ | A♠ & 8♣ | 2♠ & 7♣ | 3♠ & 6♣ | 4♠ & 5♣ |
| K♦ & 9♥ | Q♦ & 9♥ | J♦ & 9♥ | A♦ & 8♥ | 2♦ & 7♥ | 3♦ & 6♥ | 4♦ & 5♥ |
| K♦ & 9♠ | Q♦ & 9♠ | J♦ & 9♠ | A♦ & 8♠ | 2♦ & 7♠ | 3♦ & 6♠ | 4♦ & 5♠ |
| K♦ & 9♦ | Q♦ & 9♦ | J♦ & 9♦ | A♦ & 8♦ | 2♦ & 7♦ | 3♦ & 6♦ | 4♦ & 5♦ |
| K♦ & 9♣ | Q♦ & 9♣ | J♦ & 9♣ | A♦ & 8♣ | 2♦ & 7♣ | 3♦ & 6♣ | 4♦ & 5♣ |
| K♣ & 9♥ | Q♣ & 9♥ | J♣ & 9♥ | A♣ & 8♥ | 2♣ & 7♥ | 3♣ & 6♥ | 4♣ & 5♥ |
| K♣ & 9♠ | Q♣ & 9♠ | J♣ & 9♠ | A♣ & 8♠ | 2♣ & 7♠ | 3♣ & 6♠ | 4♣ & 5♠ |
| K♣ & 9♦ | Q♣ & 9♦ | J♣ & 9♦ | A♣ & 8♦ | 2♣ & 7♦ | 3♣ & 6♦ | 4♣ & 5♦ |
| K♣ & 9♣ | Q♣ & 9♣ | J♣ & 9♣ | A♣ & 8♣ | 2♣ & 7♣ | 3♣ & 6♣ | 4♣ & 5♣ |

10 (TEN) - 112 POSSIBILITIES

| | | | | | | |
|---|---|---|---|---|---|---|
| K♥ & 10♥ | Q♥ & 10♥ | J♥ & 10♥ | A♥ & 9♥ | 2♥ & 8♥ | 3♥ & 7♥ | 4♥ & 6♥ |
| K♥ & 10♠ | Q♥ & 10♠ | J♥ & 10♠ | A♥ & 9♠ | 2♥ & 8♠ | 3♥ & 7♠ | 4♥ & 6♠ |
| K♥ & 10♦ | Q♥ & 10♦ | J♥ & 10♦ | A♥ & 9♦ | 2♥ & 8♦ | 3♥ & 7♦ | 4♥ & 6♦ |
| K♥ & 10♣ | Q♥ & 10♣ | J♥ & 10♣ | A♥ & 9♣ | 2♥ & 8♣ | 3♥ & 7♣ | 4♥ & 6♣ |
| K♠ & 10♥ | Q♠ & 10♥ | J♠ & 10♥ | A♠ & 9♥ | 2♠ & 8♥ | 3♠ & 7♥ | 4♠ & 6♥ |
| K♠ & 10♠ | Q♠ & 10♠ | J♠ & 10♠ | A♠ & 9♠ | 2♠ & 8♠ | 3♠ & 7♠ | 4♠ & 6♠ |
| K♠ & 10♦ | Q♠ & 10♦ | J♠ & 10♦ | A♠ & 9♦ | 2♠ & 8♦ | 3♠ & 7♦ | 4♠ & 6♦ |
| K♠ & 10♣ | Q♠ & 10♣ | J♠ & 10♣ | A♠ & 9♣ | 2♠ & 8♣ | 3♠ & 7♣ | 4♠ & 6♣ |
| K♦ & 10♥ | Q♦ & 10♥ | J♦ & 10♥ | A♦ & 9♥ | 2♦ & 8♥ | 3♦ & 7♥ | 4♦ & 6♥ |
| K♦ & 10♠ | Q♦ & 10♠ | J♦ & 10♠ | A♦ & 9♠ | 2♦ & 8♠ | 3♦ & 7♠ | 4♦ & 6♠ |
| K♦ & 10♦ | Q♦ & 10♦ | J♦ & 10♦ | A♦ & 9♦ | 2♦ & 8♦ | 3♦ & 7♦ | 4♦ & 6♦ |
| K♦ & 10♣ | Q♦ & 10♣ | J♦ & 10♣ | A♦ & 9♣ | 2♦ & 8♣ | 3♦ & 7♣ | 4♦ & 6♣ |
| K♣ & 10♥ | Q♣ & 10♥ | J♣ & 10♥ | A♣ & 9♥ | 2♣ & 8♥ | 3♣ & 7♥ | 4♣ & 6♥ |
| K♣ & 10♠ | Q♣ & 10♠ | J♣ & 10♠ | A♣ & 9♠ | 2♣ & 8♠ | 3♣ & 7♠ | 4♣ & 6♠ |
| K♣ & 10♦ | Q♣ & 10♦ | J♣ & 10♦ | A♣ & 9♦ | 2♣ & 8♦ | 3♣ & 7♦ | 4♣ & 6♦ |
| K♣ & 10♣ | Q♣ &10♣ | J♣ & 10♣ | A♣ & 9♣ | 2♣ & 8♣ | 3♣ & 7♣ | 4♣ & 6♣ |

Fig. 2e

Table 2 continued . . .

11 (ELEVEN) - 80 POSSIBILITIES

| | | | | |
|---|---|---|---|---|
| A♥ & 10♥ | 2♥ & 9♥ | 3♥ & 8♥ | 4♥ & 7♥ | 5♥ & 6♥ |
| A♥ & 10♠ | 2♥ & 9♠ | 3♥ & 8♠ | 4♥ & 7♠ | 5♥ & 6♠ |
| A♥ & 10♦ | 2♥ & 9♦ | 3♥ & 8♦ | 4♥ & 7♦ | 5♥ & 6♦ |
| A♥ & 10♣ | 2♥ & 9♣ | 3♥ & 8♣ | 4♥ & 7♣ | 5♥ & 6♣ |
| A♠ & 10♥ | 2♠ & 9♥ | 3♠ & 8♥ | 4♠ & 7♥ | 5♠ & 6♥ |
| A♠ & 10♠ | 2♠ & 9♠ | 3♠ & 8♠ | 4♠ & 7♠ | 5♠ & 6♠ |
| A♠ & 10♦ | 2♠ & 9♦ | 3♠ & 8♦ | 4♠ & 7♦ | 5♠ & 6♦ |
| A♠ & 10♣ | 2♠ & 9♣ | 3♠ & 8♣ | 4♠ & 7♣ | 5♠ & 6♣ |
| A♦ & 10♥ | 2♦ & 9♥ | 3♦ & 8♥ | 4♦ & 7♥ | 5♦ & 6♥ |
| A♦ & 10♠ | 2♦ & 9♠ | 3♦ & 8♠ | 4♦ & 7♠ | 5♦ & 6♠ |
| A♦ & 10♦ | 2♦ & 9♦ | 3♦ & 8♦ | 4♦ & 7♦ | 5♦ & 6♦ |
| A♦ & 10♣ | 2♦ & 9♣ | 3♦ & 8♣ | 4♦ & 7♣ | 5♦ & 6♣ |
| A♣ & 10♥ | 2♣ & 9♥ | 3♣ & 8♥ | 4♣ & 7♥ | 5♣ & 6♥ |
| A♣ & 10♠ | 2♣ & 9♠ | 3♣ & 8♠ | 4♣ & 7♠ | 5♣ & 6♠ |
| A♣ & 10♦ | 2♣ & 9♦ | 3♣ & 8♦ | 4♣ & 7♦ | 5♣ & 6♦ |
| A♣ & 10♣ | 2♣ & 9♣ | 3♣ & 8♣ | 4♣ & 7♣ | 5♣ & 6♣ |

12 (TWELVE) - 64 POSSIBILITIES

| | | | |
|---|---|---|---|
| 2♥ & 10♥ | 3♥ & 9♥ | 4♥ & 8♥ | 5♥ & 7♥ |
| 2♥ & 10♠ | 3♥ & 9♠ | 4♥ & 8♠ | 5♥ & 7♠ |
| 2♥ & 10♦ | 3♥ & 9♦ | 4♥ & 8♦ | 5♥ & 7♦ |
| 2♥ & 10♣ | 3♥ & 9♣ | 4♥ & 8♣ | 5♥ & 7♣ |
| 2♠ & 10♥ | 3♠ & 9♥ | 4♠ & 8♥ | 5♠ & 7♥ |
| 2♠ & 10♠ | 3♠ & 9♠ | 4♠ & 8♠ | 5♠ & 7♠ |
| 2♠ & 10♦ | 3♠ & 9♦ | 4♠ & 8♦ | 5♠ & 7♦ |
| 2♠ & 10♣ | 3♠ & 9♣ | 4♠ & 8♣ | 5♠ & 7♣ |
| 2♦ & 10♥ | 3♦ & 9♥ | 4♦ & 8♥ | 5♦ & 7♥ |
| 2♦ & 10♠ | 3♦ & 9♠ | 4♦ & 8♠ | 5♦ & 7♠ |
| 2♦ & 10♦ | 3♦ & 9♦ | 4♦ & 8♦ | 5♦ & 7♦ |
| 2♦ & 10♣ | 3♦ & 9♣ | 4♦ & 8♣ | 5♦ & 7♣ |
| 2♣ & 10♥ | 3♣ & 9♥ | 4♣ & 8♥ | 5♣ & 7♥ |
| 2♣ & 10♠ | 3♣ & 9♠ | 4♣ & 8♠ | 5♣ & 7♠ |
| 2♣ & 10♦ | 3♣ & 9♦ | 4♣ & 8♦ | 5♣ & 7♦ |
| 2♣ & 10♣ | 3♣ & 9♣ | 4♣ & 8♣ | 5♣ & 7♣ |

Fig. 2f

Table 2 continued . . .

13 (THIRTEEN) - 64 POSSIBILITIES

| | | | |
|---|---|---|---|
| 3♥ & 10♥ | 4♥ & 9♥ | 5♥ & 8♥ | 6♥ & 7♥ |
| 3♥ & 10♠ | 4♥ & 9♠ | 5♥ & 8♠ | 6♥ & 7♠ |
| 3♥ & 10♦ | 4♥ & 9♦ | 5♥ & 8♦ | 6♥ & 7♦ |
| 3♥ & 10♣ | 4♥ & 9♣ | 5♥ & 8♣ | 6♥ & 7♣ |
| 3♠ & 10♥ | 4♠ & 9♥ | 5♠ & 8♥ | 6♠ & 7♥ |
| 3♠ & 10♠ | 4♠ & 9♠ | 5♠ & 8♠ | 6♠ & 7♠ |
| 3♠ & 10♦ | 4♠ & 9♦ | 5♠ & 8♦ | 6♠ & 7♦ |
| 3♠ & 10♣ | 4♠ & 9♣ | 5♠ & 8♣ | 6♠ & 7♣ |
| 3♦ & 10♥ | 4♦ & 9♥ | 5♦ & 8♥ | 6♦ & 7♥ |
| 3♦ & 10♠ | 4♦ & 9♠ | 5♦ & 8♠ | 6♦ & 7♠ |
| 3♦ & 10♦ | 4♦ & 9♦ | 5♦ & 8♦ | 6♦ & 7♦ |
| 3♦ & 10♣ | 4♦ & 9♣ | 5♦ & 8♣ | 6♦ & 7♣ |
| 3♣ & 10♥ | 4♣ & 9♥ | 5♣ & 8♥ | 6♣ & 7♥ |
| 3♣ & 10♠ | 4♣ & 9♠ | 5♣ & 8♠ | 6♣ & 7♠ |
| 3♣ & 10♦ | 4♣ & 9♦ | 5♣ & 8♦ | 6♣ & 7♦ |
| 3♣ & 10♣ | 4♣ & 9♣ | 5♣ & 8♣ | 6♣ & 7♣ |

14 (FOURTEEN) - 48 POSSIBILITIES

| | | |
|---|---|---|
| 4♥ & 10♥ | 5♥ & 9♥ | 6♥ & 8♥ |
| 4♥ & 10♠ | 5♥ & 9♠ | 6♥ & 8♠ |
| 4♥ & 10♦ | 5♥ & 9♦ | 6♥ & 8♦ |
| 4♥ & 10♣ | 5♥ & 9♣ | 6♥ & 8♣ |
| 4♠ & 10♥ | 5♠ & 9♥ | 6♠ & 8♥ |
| 4♠ & 10♠ | 5♠ & 9♠ | 6♠ & 8♠ |
| 4♠ & 10♦ | 5♠ & 9♦ | 6♠ & 8♦ |
| 4♠ & 10♣ | 5♠ & 9♣ | 6♠ & 8♣ |
| 4♦ & 10♥ | 5♦ & 9♥ | 6♦ & 8♥ |
| 4♦ & 10♠ | 5♦ & 9♠ | 6♦ & 8♠ |
| 4♦ & 10♦ | 5♦ & 9♦ | 6♦ & 8♦ |
| 4♦ & 10♣ | 5♦ & 9♣ | 6♦ & 8♣ |
| 4♣ & 10♥ | 5♣ & 9♥ | 6♣ & 8♥ |
| 4♣ & 10♠ | 5♣ & 9♠ | 6♣ & 8♠ |
| 4♣ & 10♦ | 5♣ & 9♦ | 6♣ & 8♦ |
| 4♣ & 10♣ | 5♣ & 9♣ | 6♣ & 8♣ |

15 (FIFTEEN) 48 POSSIBILITIES

| | | |
|---|---|---|
| 5♥ & 10♥ | 6♥ & 9♥ | 7♥ & 8♥ |
| 5♥ & 10♠ | 6♥ & 9♠ | 7♥ & 8♠ |
| 5♥ & 10♦ | 6♥ & 9♦ | 7♥ & 8♦ |
| 5♥ & 10♣ | 6♥ & 9♣ | 7♥ & 8♣ |
| 5♠ & 10♥ | 6♠ & 9♥ | 7♠ & 8♥ |
| 5♠ & 10♠ | 6♠ & 9♠ | 7♠ & 8♠ |
| 5♠ & 10♦ | 6♠ & 9♦ | 7♠ & 8♦ |
| 5♠ & 10♣ | 6♠ & 9♣ | 7♠ & 8♣ |
| 5♦ & 10♥ | 6♦ & 9♥ | 7♦ & 8♥ |
| 5♦ & 10♠ | 6♦ & 9♠ | 7♦ & 8♠ |
| 5♦ & 10♦ | 6♦ & 9♦ | 7♦ & 8♦ |
| 5♦ & 10♣ | 6♦ & 9♣ | 7♦ & 8♣ |
| 5♣ & 10♥ | 6♣ & 9♥ | 7♣ & 8♥ |
| 5♣ & 10♠ | 6♣ & 9♠ | 7♣ & 8♠ |
| 5♣ & 10♦ | 6♣ & 9♦ | 7♣ & 8♦ |
| 5♣ & 10♣ | 6♣ & 9♣ | 7♣ & 8♣ |

16 (SIXTEEN) - 32 POSSIBILITIES

| | |
|---|---|
| 6♥ & 10♥ | 7♥ & 9♥ |
| 6♥ & 10♠ | 7♥ & 9♠ |
| 6♥ & 10♦ | 7♥ & 9♦ |
| 6♥ & 10♣ | 7♥ & 9♣ |
| 6♠ & 10♥ | 7♠ & 9♥ |
| 6♠ & 10♠ | 7♠ & 9♠ |
| 6♠ & 10♦ | 7♠ & 9♦ |
| 6♠ & 10♣ | 7♠ & 9♣ |
| 6♦ & 10♥ | 7♦ & 9♥ |
| 6♦ & 10♠ | 7♦ & 9♠ |
| 6♦ & 10♦ | 7♦ & 9♦ |
| 6♦ & 10♣ | 7♦ & 9♣ |
| 6♣ & 10♥ | 7♣ & 9♥ |
| 6♣ & 10♠ | 7♣ & 9♠ |
| 6♣ & 10♦ | 7♣ & 9♦ |
| 6♣ & 10♣ | 7♣ & 9♣ |

Fig. 2g

Table 2 continued . . .

| 17 (SEVENTEEN 32 POSSIBILITIES | | 18 (EIGHTEEN) 16 POSSIBILITIES | 19 (NINETEEN) 16 POSSIBILITIES |
|---|---|---|---|
| 7♥ & 10♥ | 8♥ & 9♥ | 8♥ & 10♥ | 9♥ & 10♥ |
| 7♥ & 10♠ | 8♥ & 9♠ | 8♥ & 10♠ | 9♥ & 10♠ |
| 7♥ & 10♦ | 8♥ & 9♦ | 8♥ & 10♦ | 9♥ & 10♦ |
| 7♥ & 10♣ | 8♥ & 9♣ | 8♥ & 10♣ | 9♥ & 10♣ |
| 7♠ & 10♥ | 8♠ & 9♥ | 8♠ & 10♥ | 9♠ & 10♥ |
| 7♠ & 10♠ | 8♠ & 9♠ | 8♠ & 10♠ | 9♠ & 10♠ |
| 7♠ & 10♦ | 8♠ & 9♦ | 8♠ & 10♦ | 9♠ & 10♦ |
| 7♠ & 10♣ | 8♠ & 9♣ | 8♠ & 10♣ | 9♠ & 10♣ |
| 7♦ & 10♥ | 8♦ & 9♥ | 8♦ & 10♥ | 9♦ & 10♥ |
| 7♦ & 10♠ | 8♦ & 9♠ | 8♦ & 10♠ | 9♦ & 10♠ |
| 7♦ & 10♦ | 8♦ & 9♦ | 8♦ & 10♦ | 9♦ & 10♦ |
| 7♦ & 10♣ | 8♦ & 9♣ | 8♦ & 10♣ | 9♦ & 10♣ |
| 7♣ & 10♥ | 8♣ & 9♥ | 8♣ & 10♥ | 9♣ & 10♥ |
| 7♣ & 10♠ | 8♣ & 9♠ | 8♣ & 10♠ | 9♣ & 10♠ |
| 7♣ & 10♦ | 8♣ & 9♦ | 8♣ & 10♦ | 9♣ & 10♦ |
| 7♣ & 10♣ | 8♣ & 9♣ | 8♣ & 10♣ | 9♣ & 10♣ |

20 (TWENTY) - NO POSSIBILITIES

Fig. 2h

METHOD OF PLAYING A CASINO TYPE CARD GAME

BACKGROUND OF THE INVENTION

1. Field of the Invention

This invention relates to a method of playing a card game suitable for wagering play, both in California style card casinos as well as in Las Vegas type casino play. The game disclosed herein may be adapted and combined with other card games including conventional card games such as Baccarat.

2. State of the Prior Art

Numerous card games based on the standard fifty-two card playing deck are known, and more than a few of these are played for money wagers in casinos. The wagering card games vary in complexity. Some, such as the various forms of Poker, require considerable expertise and may present a life-long learning challenge to their devotees. Other games are more easily learned, and depend more on pure chance than on the player's skill.

Complex games or games which depend heavily on strategy discourage novice players from participating against more highly skilled players. Novice players are often intimidated for fear of not following the rules or good strategy and being subject to invectives from other players.

A continuing need exists for simple wagering card games which can be quickly learned, yet which provide an interesting level of excitement to both experienced and novice players.

SUMMARY OF THE INVENTION

The card game of this invention is very easy to learn and requires little skill on the part of the player. The outcome of the game is determined by chance or luck and is not affected by any strategy on the part of the player. Of special interest to casino play is that little opportunity for cheating exists. Furthermore, exposing one player's cards to view by other players will not change the outcome of the deal. Experienced card players will appreciate the 50—50 odds of winning.

The card game according to this invention is played with one or more decks of playing cards. A player designated as banker makes an election between 9 up and 8 down. Wagers are placed, and two cards are dealt to each player as well as the banker. Each player receives action from the banker in turn, for as long as the banker's wager suffices to match the wagers of the successive players. The banker's hand and the hand of a first player are opened. The two card hands are classified as pair hands and non-pair hands. Pair hands include any two cards paired according to face value or figure irrespective of card suit, and range from a pair of twos to a pair of aces, with the remaining numbered cards ranked above the twos in order of increasing numerical sequence and the figure cards ranked above the ten card in Jack, Queen, King sequence. Non-pair hands have a hand value computed by summing the face numerical value of the two cards, figure cards having a value of zero. The value of any non-pair card hand can range from zero to nineteen. That is, a non-pair hand may be either 9-up, i.e. have a value from nine to nineteen, or may be 8-down, with a hand value from eight to zero.

If the value of the banker's hand conforms to the 9-up or 8-down election made, the banker wins against all players except against a player's pair hand, in which case that player's hand wins as against the banker unless the banker also holds a pair. In the latter case, the pair of higher value wins. Pairs of equal value tie. If neither the banker's hand nor the player's hand conform to the election, and neither has a pair, the two hands tie.

An added measure of excitement can be introduced by increasing the payoff to a winning pair hand, for example, double the player's wager. This emulates the increased payoff to a "natural 21" in the game of Blackjack.

The rules for dealing the cards and settling of the wagers may follow accepted practice in other wagering card games, but may be subject to variations according to house rules and local law.

Parts of the game of this invention may be combined with other existing card games in which a two card hand is dealt to a banker. For example, players in such a game may be permitted to place a 9-up or 8-down side-bet on the value of the banker's hand dealt in an underlying card game. Alternatively, such a side bet might also be permitted on card hands dealt to other participants in the underlying card game. The side-bets need not change or affect the existing rules of play of the underlying game, which may proceed normally after settlement of the side-bet wagers.

For example, such a side bet can be incorporated into the conventional card games of Baccarat or Blackjack. In either of these games a two-card hand is dealt to the Banker or Dealer, respectively. Such combination provides double wagering action in a single card play, increasing the betting options of the players

BRIEF DESCRIPTION OF THE DRAWINGS

FIG. 1 illustrates Table 1 lists all possible card hands in the game of this invention, pair hands listed first followed by the non-pair hands, and provides statistical information for each card hand.

Table 2, spanning FIGS. 2*a* through 2*h*, illustrates in tabular form every possible two-card combination for each possible hand value drawn from a single standard deck of fifty-two playing cards.

DETAILED DESCRIPTION OF THE PREFERRED EMBODIMENTS

The game according to this invention is played by two or more participants with at least one but preferably several conventional decks of fifty-two playing cards. For casino play, it is contemplated that eight decks of fifty-two cards would be used, dealt from a conventional card shoe, for a table of eight players.

Each hand is played by first selecting a banker from among the players. The remaining or non-banker players each play their hands against the hand held by the banker. Before dealing the hand, the banker makes an election between two possible outcomes in the numerical value of the hand to be dealt to him or her, as will be explained below. This election is either "9-up" or "8-down".

The banker and each player then place a bet or wager. The amount of the wager may be any amount, limited only by house limits or rules. A dealer, typically a non-player employee of the casino, them deals the cards. Two cards are dealt face down to the banker and to each of the players. The banker and each player may then see their hand privately, i.e. holding hand closed. In some casinos, house rules may prevent the banker from looking at his or her hand, and instead, the dealer opens the banker's hand, laying the cards face up on the playing table. In others, the banker's cards may be dealt face up.

It is conventional in card casinos to throw three dice at this point in the play to determine where the "action" is to start, i.e. with which player. This means that one of the players at the table is chosen to be first to open his or her hand, to determine if the hand wins or looses against the banker's hand.

The two-card hand may be either a pair hand or a non-pair hand. Pair hands range from a pair of aces at the high end to a pair of twos at the low end. Non-pair hands are either "9-up" or "8-down". The value of the banker's hand and each player's hand is determined by summing the numerical face value of the two cards in each hand, an ace having a value of one and all figure cards having a value of zero. The actual numerical values of the non-pair hands range from zero, for any two non-pair figure cards, to a maximum of nineteen, for a nine card and a ten card. Hands having a numerical value from nine to nineteen are "9-up", and hands having a numerical value from eight to zero are "8-down".

The outcome of play as between the banker and any one of the players is determined according to the following rules:

1) A hand consisting of any pair wins against any hand which is not a pair.
2) As between two pairs, the hand having the highest pair wins.
3) If the banker's hand meets the election of nine-up or eight-down, then the banker wins as against any player whose hand fails to meet the same election and ties against any player whose hand does meet the election;
4) If the banker's hand does not meet the election of nine-up or eight-down then the banker loses against a player whose hand does meet the election and ties with a player whose hand also does not meet the election.

Table 1 lists all possible card hands in the game of this invention. The pair hands are listed first, in descending order of value, aces highest and deuces lowest. The non-pair hands are then listed in ascending order of actual numerical value, from zero to nineteen (twenty is always a pair hand and is not counted among the non-pair hands). Table 1 has three columns which provide statistical information for a single standard fifty-two card deck. The left hand column shows the number of possible card combinations, ignoring card suit, which yield the particular card hand. The center column indicates the number of different two-card combinations drawn from a fifty-two card deck, taking into account the card suit, which can give rise to each hand. Finally, the right hand column gives the statistical probability of drawing that particular hand out of all the possible hands listed in the Table.

Two important points are apparent from the statistical data column. Firstly, the odds or chances of drawing any one pair out of the thirteen different possible pair hands is the same, i.e. 0.45% in any given hand. The odds of drawing a pair hand, consisting of any of the thirteen possible pairs, is 5.88% (0.45% multiplied by thirteen). Secondly, although the odds of drawing different non-pair hands vary, the odds of drawing a non-pair hand having a value from nine to nineteen (a nine-up hand) is the same as the odds of drawings a non-pair hand having a value from eight to zero (an eight down hand).

Table 2, spanning FIGS. 2*a* through 2*d*, tabulates every possible two-card combination for each possible hand value in a single standard deck of fifty-two playing cards. The hand value is indicated as a sub-heading and the two-card combinations yielding that particular hand value, including face value and card suit, are tabulated under each sub-heading. The tabulation of pair hands shows that, for each fifty-two card deck, each of the thirteen pairs can be made up of six different two-card combinations of equal face value or figure but different suit, i.e. heart, diamond, club and spade. This gives rise to 78 different two-card combinations for a pair hand consisting of any of the thirteen possible pairs. In a similar manner the two-card combinations giving rise to each of the non-pair hands having values from zero to nineteen are tabulated under corresponding sub-headings zero through nineteen. Each sub-heading also indicates the number of different two-card combinations in the tabulation. In the non-pair tabulations the two-card combinations vary both in face value or figure as well as in suit. It will be appreciated that the number of two-card combinations for each hand in the subheadings of Table 1 correspond to the like numerals in the center column of Table 2.

If the first player's hand wins against the banker, that player's wager is satisfied from the banker's wager. If the first player's wager is greater than the banker's wager, then the first player's wager is only satisfied to the extent of the bankers' wager and no more. If the banker's wager is not exhausted after satisfying the first player's wager, a second player's hand is opened. Play usually proceeds clockwise around the table from the first player, but the direction of play is not critical to the game. Play continues with successive players until the all players' hands are opened and, if winning, their corresponding bets satisfied from the banker's wager. If any hand of the players loses to the banker, the losing player's wager is left on the table until either all of the players hands are opened, or play stops short of all non-banker players because the banker's wager has been exhausted. The bets of the losing players are then paid to the banker. All cards are then collected from the table and a new two-card hand is dealt to each player, banker and non-banker. Typically the banker keeps that role during two successive hands, after which the opportunity to play banker passes in rotation to the next player around the table, in a clockwise or counter clockwise direction. This opportunity may be declined, in which case the next player gets the chance to be banker.

The just described manner in which the banker is chosen and in which play proceeds among the various players around the table against the banker, as well as the handling of the wagers as each player's hand is played, is accepted practice in the play of conventional card games, such as the different variations of the game of poker, in California card casinos. Casinos in California, a State where gambling has not been legalized, do not participate in the card games but instead derive revenue by providing the venue, i.e. the playing table and other facilities where the games are played as well as services such as those of a card dealer who deals the cards and handles the wagers placed on the table. The casino neither receives nor satisfies the wagers of the players, who therefore in the aggregate can only win up to the extent of the banker's wager in any given hand. The casino or house normally collects a small fixed fee from each player for each card hand played. It is customary to waive this fee for any player who does not "receive action" in a particular hand because the banker's wager became exhausted prior to opening that player's hand, or if not exhausted, is insufficient to meet that player's wager.

The game according to this invention may also be played in Las Vegas style gambling casinos. In that case, the rules described above may be modified to the extent that the casino participates in the game by covering any shortage in the banker's wager against the wagers of the non-banker players, and the casino collects any winnings by the banker in excess of the banker's wager. This ensures that all players "receive action" in each hand played.

The game according to this invention may also be combined, in part or in whole, with other, conventional games in which a two-card hand is dealt to each player and play proceeds against a banker or dealer, whether in Las Vegas type gambling or in a California casino. In such a combination each player may place a side bet on the outcome of the banker's or dealer's two-card hand according to the rules of the present game. The side-bet options may be limited for the sake of simplicity. For example each player may bet on one of two possible outcomes for the banker's or dealer's hand: nine-up or eight-down. If the player's side bet correctly predicts the banker's or dealer's hand, the side bet is satisfied by the banker, dealer or house. Otherwise, that player's side bet is lost to the banker, dealer or house. If the banker's or dealer's hand is a pair, the side-bet may be considered a draw. Alternatively, the side-bet may extend to the three options: nine-up, eight-down or pair, such that any of these three outcomes produces a win or loss on the side-bet. The game of this invention may also be played simultaneously with the other, conventional game, in the manner originally disclosed above. For example, this game may be combined with the game of Blackjack by allowing additional cards to be drawn by the banker and the players after settlement of the wagers placed on the first two cards according to the game of this invention. Separate wagers would be placed on the outcome of the Blackjack game for each hand.

One combination presently contemplated by the applicant involves the game of Baccarat or Blackjack, or other similar card game. In Baccarat type games, a two card hand is dealt to each of a Banker and a Player. A number of players around the table participates by betting either on the Banker or the Player. The Banker's hand is open, i.e., is dealt face-up. Both the Banker and Player may then draw an additional card under the rules of Baccarat. However, for purposes of the side-bet according to this invention, the side-bet is preferably placed only on the first two cards of the Banker. Similarly, a side-bet could also be placed on the first two cards of the Player, if the greater complexity of the resulting game is acceptable. Incorporation of the side-bet need not change the rules of the underlying Baccarat game, but can provide an added avenue of speculation and amusement for the players while producing increased revenue for the gaming house.

A similar combination can be made with the game of Blackjack, in which players would be given the opportunity to place "9-up" or "8-down" side-bets on the first two cards of the Dealer.

In the simplest form of the game according to the present invention, bets may be placed on the outcome of a two card hand only as to the "9-up" or "8-down" outcome of the hand. As explained above and illustrated in the accompanying Tables, the odds are equal or fifty-fifty for the "9-up" or "8-down" outcome of a two card hand drawn from an integral number of standard playing card decks. This simplest form of the invention may be played as a stand-alone game, in which the house or casino may take bets on either of these two outcomes of a dealer's hand. In this simplest form of the game pair hands do not produce a win or lose outcome, and are considered a draw. This form of the game can be viewed as the card equivalent of the "odd-even" or "black-red" bets in the game of roulette, where the odds also are fifty-fifty.

Particular embodiments of the present invention have been described and illustrated for purposes of clarity and example only. It should be understood that many changes, substitutions and modifications to the described embodiments will become apparent to those having ordinary skill in the art, without thereby departing from the scope of this invention which is defined by the following claims.

What is claimed is:

1. A method for playing a card game among two or more participants including at least one banker, comprising the steps of:

providing a supply of playing cards including one or more decks of fifty-two playing cards;

making an election of nine-up or eight-down;

dealing a hand of two cards to each of said players and to said banker;

declaring a win, lose or tie outcome as between said hand dealt to said banker and said hand dealt to any one of said players according to the following rules:

obtaining the sum value of each non-pair card hand by adding the numerical face Value of the two cards, figure cards having a zero value, a sum value of nine to nineteen being 9-up and a sum value of zero to eight being 8-down;

determining whether the sum value of said each hand does or does not meet said election;

if the banker's hand does meet said election, the banker's hand wins against a player's hand which does not meet said election;

if the banker's hand does not meet said election, then the banker's hand loses to a player's hand which does meet said election; and if the banker's and a player's hands both do meet the election or both do not meet the election, then the banker's and player's hands tie.

2. The method for playing a card game according to claim 1, further comprising the steps of making a wager by each of said players and said banker prior to said declaring and settling the wagers by paying to a one of said players the amount of that player's wager from said banker's wager by if each said a one of said players has a winning hand, or, if said a one of said players has a losing hand then said banker collecting the wager of said a one of said players.

3. The method for playing a card game according to claim 2 wherein said settling of said wagers proceeds only if said wager of said banker, or remaining portion thereof, at least matches the said wager of said a one of said players.

4. The method for playing a card game according to claim 2 wherein said step of paying comprises paying an amount greater than said wager to each player holding a said winning hand consisting of a pair.

5. The method for playing a card game according to claim 4 wherein said greater amount is twice the amount of said wager of said each player.

6. The method for playing a card game according to claim 1 wherein said election is made by said banker.

7. The method for playing a card game according to claim 1 wherein said banker is selected from among said players.

8. The method for playing a card game according to claim 7 wherein the role of said banker is assumed in rotation among said players.

9. The method for playing a card game according to claim 1 wherein a pair of aces is ranked as the pair of highest value.

10. The method for playing a card game according to claim 1 further comprising the step of placing a marker indicative of said election.

11. The method for playing a card game according to claim 1 wherein said supply of playing cards comprises eight decks of 52 playing cards.

12. The method for playing a card game according to claim 1 wherein said dealing is by drawing said cards from a card shoe.

13. The method for playing a card game according to claim 1 wherein said dealing comprises selecting by chance means one of said players to whom a first card is dealt.

14. The method for playing a card game according to claim 13 wherein said chance means comprises rolling dice.

15. The method of claim 1 wherein as between a banker's hand and a player's hand, regardless of said election, a hand consisting of a pair wins over a non-pair hand and as between two pairs the hand with the higher pair wins.

16. A method for playing a card game comprising the steps of providing one or more decks of 52 playing cards, dealing a two card hand to at least one player, providing one or more participants other than said least one player, at least one of said one or more participants making an election on the numerical value of said two card hand being either nine-up or eight-down, and placing a wager on the election, and determining whether the hand is nine-up or eight down by summing the face values of said two cards in any non-pair card hand, wherein all figure cards have a face value of zero, nine-up representing a sum value of said non-pair card hand from nine to nineteen, eight-down representing a sum value of said non-pair card hand from zero to eight.

17. The method of claim 16 wherein said step of dealing a two card hand is a hand in a game of Baccarat and said least one player is the Banker in the game of Baccarat.

18. The method of claim 16 wherein said step of dealing a two card hand is a hand in a conventional card game wherein said least one player is a Banker who plays against a no-banker Player selected from among said one or more participants.

19. A method for playing a Baccarat type card game comprising the steps of providing one or more decks of 52 playing cards, dealing a two card hand to each of a Banker and a Player, one or more other participants placing a first wager in accordance with the rules of said Baccarat type card game on the card hands dealt to said Banker or said non-banker Player, any of said one or more other participants making an election on the numerical value of said two card hand dealt to one or both of said Banker and said non-banker Player being either nine-up or eight-down, placing a wager on said election, and determining said numerical value by summing the face values of the two cards in any non-pair card hand, wherein all figure cards have a face value of zero, nine-up representing a sum value of said non-pair two card hand from nine to nineteen, eight-down representing a sum value of said non-pair two card hand from zero to eight.

20. The method of claim 19 further comprising the step of continuing play by said Banker and said non-banker Player in accordance with conventional rules of said Baccarat type card game.

21. The method of claim 17 wherein placing said further wager is limited to placing a further wager on said numerical value of said two card hand dealt to said Banker.

22. A card game for play among two or more participants one of which is designated banker, comprising the steps of:

providing a supply of playing cards including one or more decks of fifty-two cards;

said banker making an election of nine-up or eight-down;

dealing a hand of two cards to each of said players and to said banker;

declaring a win, lose or tie outcome of a non-pair said hand held by any one of said players as against a non-pair said hand held by the banker according to the following rules:

obtaining the sum value of a non-pair said hand by adding the numerical face value of said two cards in said hand, figure cards having a zero value, a sum value of nine to nineteen being nine-up and a sum value of zero to eight being eight-down;

determining whether the sum value of said hand does or does not meet said election;

if the banker's hand does meet said election, the banker's hand wins against a player's hand which does not meet said election;

if the banker's hand does not meet said election, then the banker's hand loses to a player's hand which does meet said election;

if the banker's and a player's hands both do meet the election or both do not meet the election, then the banker's and player's hands tie.

23. The card game according to claim 22 further comprising the rule that as between a banker's hand and a player's hand, regardless of said election, a hand consisting of a pair wins over a non-pair hand and as between two pairs the hand with the higher pair wins.

24. A method for playing a card game comprising the steps of providing one or more decks of 52 playing cards, dealing a two card hand to a player, said player making an election on the sum value of said two-card hand being either nine-up or eight-down, said player placing a wager on said election, and determining said sum value by adding the numerical face value of the two cards in any non-pair said hand, wherein all figure cards have a zero face value, nine-up being a sum value of said non-pair card hand of nine to nineteen and eight-down being a sum value of said non-pair card hand of zero to eight.

* * * * *